United States Patent [19]

Perepezko et al.

[11] Patent Number: 5,066,324

[45] Date of Patent: Nov. 19, 1991

[54] METHOD OF EVALUATION AND IDENTIFICATION FOR THE DESIGN OF EFFECTIVE INOCULATION AGENTS

[75] Inventors: John H. Perepezko; Mark K. Hoffmeyer, both of Madison, Wis.

[73] Assignee: Wisconsin Alumni Research Foundation, Madison, Wis.

[21] Appl. No.: 485,931

[22] Filed: Feb. 26, 1991

[51] Int. Cl.[5] ..... B22D 23/08

[52] U.S. Cl. ..... 75/335; 75/375; 264/0.5; 264/5

[58] Field of Search ..... 75/331, 332, 333, 334, 75/335, 338, 339, 340, 375, 380, 382, 384, 386; 264/5, 7

[56] References Cited

U.S. PATENT DOCUMENTS

| | | | |
|---|---|---|---|
| 4,042,374 | 8/1977 | Rasmussen et al. | 264/5 |
| 4,282,034 | 8/1981 | Smith et al. | 264/7 |
| 4,321,086 | 3/1982 | Perepezko et al. | 75/331 |

OTHER PUBLICATIONS

D. Turnbull et al., "Nucleation Catalysis," Ind. Eng. Chem., vol. 44, No. 6, pp. 1292-1298, Jun. 1952.

I. Maxwell et al., "A Simple Model for Grain Refinement During Solidification," Acta Metallurgica, vol. 23, pp. 229-237.

M. M. Guzowski et al., "The Role of Boron in the Grain Refinement of Aluminum with Titanium," Met. Trans., vol. 18A, pp. 603-619, Apr. 1987.

M. I. Pope and M. D. Judd, "*Differential Thermal Analysis a Guide to the Technique and its Applications,*" Heyden Publ., London 1977 (book), pp. 1-42.

A. Raman and K. Schubert, "Uber den Aufbau einiger zu $TiAl_3$ verwandter Legierungsreihen," Z. Metalldke, 56, 1, pp. 44-52 (1965) (In German; see phase diagram p. 46).

H. Goldschmidt, *Interstititial Alloys* (book), Butterworths and Co., Ltd., 1987, pp. 331-332.

J. H. Perepezko and S. E. LeBeau, "Nucleation of Aluminum During Solidification," in Aluminum Transformation Technology and Applications-1981 ASM (Metals Park, Oh.), pp. 309-346 (1982).

J. H. Perepezko, "Nucleation Kinetics," in Principles of Solidification, pp. 101-108, 1988.

M. K. Hoffmeyer and J. H. Perepezko, "Nucleation Catalysis by Dispered Particles," *Scripta Metallurgica,* vol. 22, pp. 1143-1148, 1988.

*Primary Examiner*—R. Dean
*Assistant Examiner*—Sikyin Ip
*Attorney, Agent, or Firm*—Foley & Lardner

[57] ABSTRACT

The Droplet Emulsion Technique is used to produce droplets of bulk metal or metal alloys containing inoculant particles. Heterogeneous nucleation responses are then separated and identified with variances in inoculant chemistry, size, morphology, and surface conditions in the different droplets. Differential Thermal Analysis (DTA) is used to detect and to correlate thermal signals generated from as little as 50 droplets 75-100 μm in size, allowing the separation of signals generated by a minor fraction of the total droplet population. Quenching treatments are used on the samples during thermal analysis to retain the original solidification microstructures produced from effective inoculation. Differences between droplet solidification microstructures preserved from the quenching treatments allow for visual identification of effective and ineffective inoculant particles. The factors controlling effective inoculation of solid include the chemistry, morphology, crystal structure, and surface conditions of inoculant particles which are identified by using analytical x-ray and electron microbeam techniques.

20 Claims, 8 Drawing Sheets

SCHEMATIC DTA THERMOGRAM

METHOD OF EVALUATION AND IDENTIFICATION FOR THE DESIGN OF EFFECTIVE INOCULATION AGENTS

This invention was made with United States government support awarded by the United States Army Research Office (ARO), Grant DAAL 03-86-K-0114. The United States government has certain rights in this invention.

FIELD OF THE INVENTION

This invention relates generally to evaluation and identification of potent inoculant particles for the design of improved inoculant additions used as grain refining agents and/or structural modifiers in bulk metals and metal alloys.

BACKGROUND OF THE INVENTION

In almost all solidification processes, the crystallization of a bulk liquid volume occurs through favorable interaction between the melt and internal or residual catalysts which act as heterogeneous nuclei. The heterogeneous sites can be melt impurties or Other external catalysts inherent to most casting processes. Although most naturally occurring or intrinsic catalysts may be activated at undercoolings of only a few degrees, coarse constituent product phases and/or coarse columnar grain structures will usually develop in the absence of inoculant particle additions that provide for the individual or combined effects of a high nucleation frequency and a constitutional growth deterrent during solidification. Therefore, in order to modify or refine as-cast solidification microstructures, it is common practice to intentionally inoculate a melt with particle catalysts that surpass the catalytic activity of other less potent heterogeneous nuclei in contact with the bulk liquid. By using these inoculation procedures, the added catalysts can promote the formation of refined, equiaxed as-cast grain structures, refined primary phase constituents, or morphologically altered phases, all of which can either enhance desired mechanical properties or improve the surface finish of metal and alloy castings.

Given this information it is noted that inoculation treatments fall within two classes. In the first class, inoculation treatments are used to promote the nucleation of modified product phase morphologies. For example, copper phosphide particles are added to aluminum-silicon alloys to produce a refinement of the silicon phase size while the addition of sodium to an aluminum-silicon alloy will modify the growth morphology of the primary silicon. In cast irons, ferrosilicon additions promote the nucleation of graphite while additions of magnesium result in the formation of spheroidal or nodular graphite in ductile cast iron. The second class of inoculation treatments are used to alter the relative abundance and distribution of intentionally nucleated phases and usually involve the addition of particle agents that promote the formation of fine, equiaxed as-cast grain structures. Examples include the refinement of magnesium alloys via zirconium or carbon additions, the grain refinement of copper by iron, cobalt, or zirconium, and the addition of arsenic or tellurium to lead alloys. In addition, there also exists a vast commercial and experimental database concerning the grain refinement of aluminum and aluminum alloys through master alloy additions containing inoculant particles inherent to the aluminum-titanium and aluminum-titanium-boron systems. Moreover, the aluminum-titanium and aluminum-titanium-boron systems are generally used as a paragon for theoretical interpretation of inoculation and corresponding physical mechanisms concerning the realm of heterogeneous nucleation catalysis.

Although mechanisms that influence effective heterogeneous nucleation catalysis are not fully understood, based upon the prior art and associated theoretical interpretations, inoculant particles must provide two fundamental characteristics that influence the effective grain refinement of castings. These characteristics are a kinetic restriction that optimizes a high nucleation frequency and a chemical solute restriction that provides for a constitutional growth deterrent of the nucleated crystals. See. e.g., D. Turnbull and B. Vonnegut, Ind. Eng. Chem., 44, 6, 1292 (1952); I. Maxwell and A. Hellawell, Acta Met., 23, 229 (1975). Both characteristics are necessary to insure a high density of fine grains or crystals. The former condition is maximized for particle catalysts that provide surfaces possessing similar crystal chemical properties and low crystallographic misfit orientations for nucleation of the crystalline solid, while the latter condition is optimized when a peritectic type reaction occurs between the inoculant particles and the liquid and solid phases. As an ancillary condition, the nucleation process must be uniformly activated by the inoculant particles at essentially negligible undercooling levels in order to circumvent anomalous nucleation and growth of coarse columnar structures occurring in regions of castings void of effective catalyst particles.

Although the use of inoculation treatments is common in commercial practice, a considerable lack of reproducible effectiveness exists with the use and performance of most grain refining agents. For example, under ideal conditions the number of grains in a refined casting should approach the total number of inoculant particles added to the melt prior to solidification. However, bulk grain density measurements of refined aluminum castings reveal that only 1–2% of the total number of added inoculant particles actively promote the grain formation. See M. M. Guzowski, G. K. Sigworth, and D. A. Sentner, Met. Trans., 18A, 603 (1987). Further, it is virtually impossible to visually identify the active nucleant particles present within a bulk casting that contains a multitude of inactive or less active particles of variable sizes, shapes, morphologies, chemical identities, and crystal structures. For the case of aluminum, for example, visual identification of the potent inoculant population in bulk refined ingots is not possible because solidification morphologies associated with the nucleation and growth of aluminum on effective particle catalysts are usually consumed during matrix coarsening in slowly cooled ingots. Therefore, given a maximum 2% effectiveness in commercial inoculation efficiency, examination of typical inoculant particles within a bulk refined ingot will not yield an accurate representation of the actual nucleation parameters responsible for effective catalysis of grains by a minority of the inoculant particle population. Given the low efficiency and lack of certain understanding surrounding heterogeneous nucleation catalysts and inoculant operation, there is a need for a technique that allows for the identification of effective catalytic agents.

SUMMARY OF THE INVENTION

In accordance with the present invention, a method for evaluation and identification for the design of inoculation agents for bulk metals or metal alloys is based upon the Droplet Emulsion Technique (DET). Micron-sized metal droplets (5-300 μm) are prepared by heating the bulk metal or metal alloy containing inoculation particles to a molten state and then emulsifying the metal within a carrier fluid. From a droplet dispersion, heterogeneous nucleation responses produced from the solidification of the bulk metal or metal alloy on individual incorporated inoculant particles from the emulsion sample can be separated and attributed to factors such as inoculant chemistry, morphology, size, and surface conditions.

A high sensitivity Differential Thermal Analysis (DTA) is used to detect and to correlate thermal signals generated from as little as 50 droplets about 75-100 μm in size by using an analyzer. As a result, it is possible to separate signals generated by a minor fraction of the total droplet population. Quenching treatments are then used on the samples during thermal analysis to retain the original solidification microstructures so that effective and ineffective inoculant particles can be identified visually and associated with solidification morphologies through scanning electron microscopy (SEM) and optical techniques.

Whereas in bulk samples it is only possible to examine the overall effectiveness of master alloys by measuring resultant as-cast grain sizes, in droplet samples quenched at known temperatures, the actual potency of inoculant particles contained within droplets possessing characteristic solidification microstructures associated with effective nucleation can be identified and used to establish a catalytic ranking of particles contained in a master alloy. Furthermore, since background sites such as crucible walls or stirring rods are also eliminated by using this process, residual catalytic interactions are eliminated in addition to providing for an effective means to identify differences between isolated inoculant particles that promote grain refinement in a bulk solid.

Further objects, features, and advantages of the invention will be apparent from the following detailed description when taken in conjunction with the accompanying drawings.

DESCRIPTION OF THE PREFERRED METHOD

The method for evaluation and identification for the design of inoculation agents with the present invention is based upon the Droplet Emulsion Technique (DET). Micron-sized (5-300 μm) metal droplets of bulk metal or metal alloys are prepared by emulsification of the molten metal in stable carrier fluids, such as organic liquids, molten salts, inorganic glasses, and gaseous media. During emulsification, the formation of an integral surface coating on the metal through an oxidation treatment or surfactant addition is established and promotes a chemical reaction on the metal surface while in the emulsified state. This integral coating maintains the emulsified integrity of the spherical particles in their finely divided separate state for subsequent solidification.

The method for evaluation and identification for the design of inoculation agents of the present invention differs from the prior art in that the micron-sized droplets that are produced contain added foreign, or equilibrium and/or metastable in situ incorporated inoculant particles of crystalline or amorphous nature, or the formation of inoculant sites through carrier fluid coating treatment additions. The method of the present invention yields the identification of the inoculant particle constituents that act as nucleation catalysts to initiate the formation of fine, equiaxed grains during the solidification of a bulk-casting matrix or actively alter constituent phase microstructures, phase morphologies, phase sizes, and phase distributions within the matrix of an as-cast metal or metal alloy. The method of the present invention is employed in the development of more effective inoculant additives that can be used in common commercial casting practices that rely upon particle catalysts or so-called master alloy additions for phase constituent modification and grain refinement.

Figure 1:
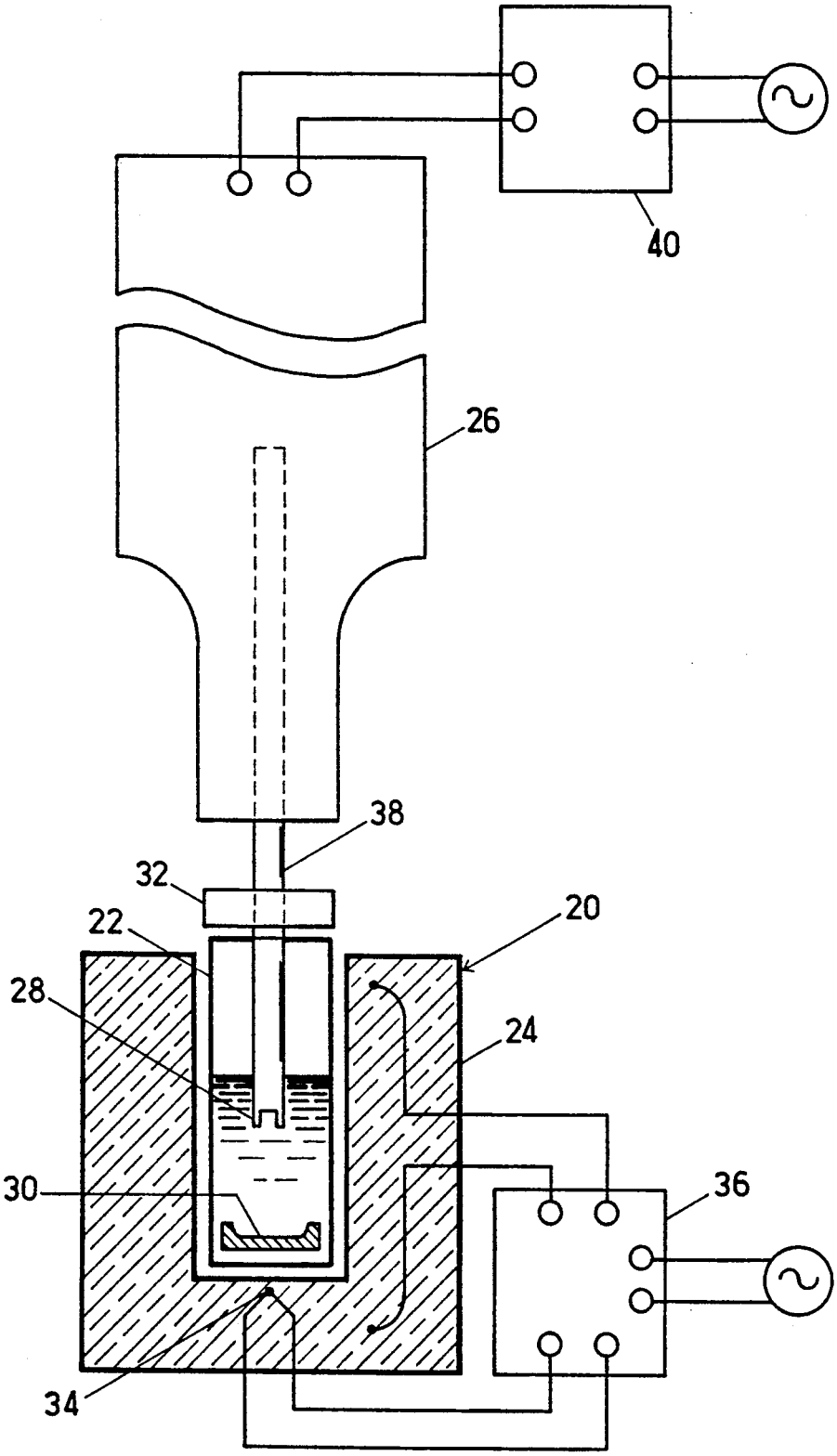
FIG. 1 is a schematic illustration of an apparatus used to produce metal droplets containing incorporated catalysts in molten salt carrier solutions in accordance with the practice of this invention.

Exemplary apparatus used in the Droplet Emulsion Technique such as is here employed, is shown schematically at 20 in FIG. 1. The apparatus 20 comprises a ceramic tube 22, a furnace 24, a high-speed electric motor 26, and ceramic blades 28. The ceramic tube 22 is contained within the furnace 24 and contains an inert carrier fluid and a bulk metal or metal alloy containing inoculants that are to be evaluated. An agitator ring 30 is positioned near the bottom of the ceramic tube 22 and an insulating cover 32 is fitted over the top of the ceramic tube 22. The temperature of the furnace 24 is measured and controlled by a thermocouple 34 and a temperature controller 36 that are connected to the furnace 24. The ceramic blades 28 are turned by a shaft 38 that transmits rotation from the high-speed electric motor 26. Speed of the motor 26 is controlled by a potentiometer or variac 40.

When the furnace 24 is heated to completely melt the bulk metal or metal alloy and the inert carrier, the motor 26 is turned on and mechanically shears the bulk metal or metal alloy into a dispersion within the ceramic tube 22. The presence of the agitator ring 30 assists in the dispersion. After emulsification, the inert carrier/-bulk metal or metal alloy droplet emulsion mixture is poured onto a quench plate and solidified into a mass. The bulk metal or metal alloy droplets are then recovered from the mass by dissolving the carrier and filtering to remove the carrier as a filtrate. The inert carrier is typically a salt that is dissolved in distilled, deionized water and filtration is through glass microfiber papers. The Droplet Emulsion Technique as herein described is explained in further detail in U.S. Pat. Nos. 4,042,374 and 4,321,086 issued to Rasmussen, et al. and Perepezko, et al., respectively, and incorporated herein by reference.

Figure 2:
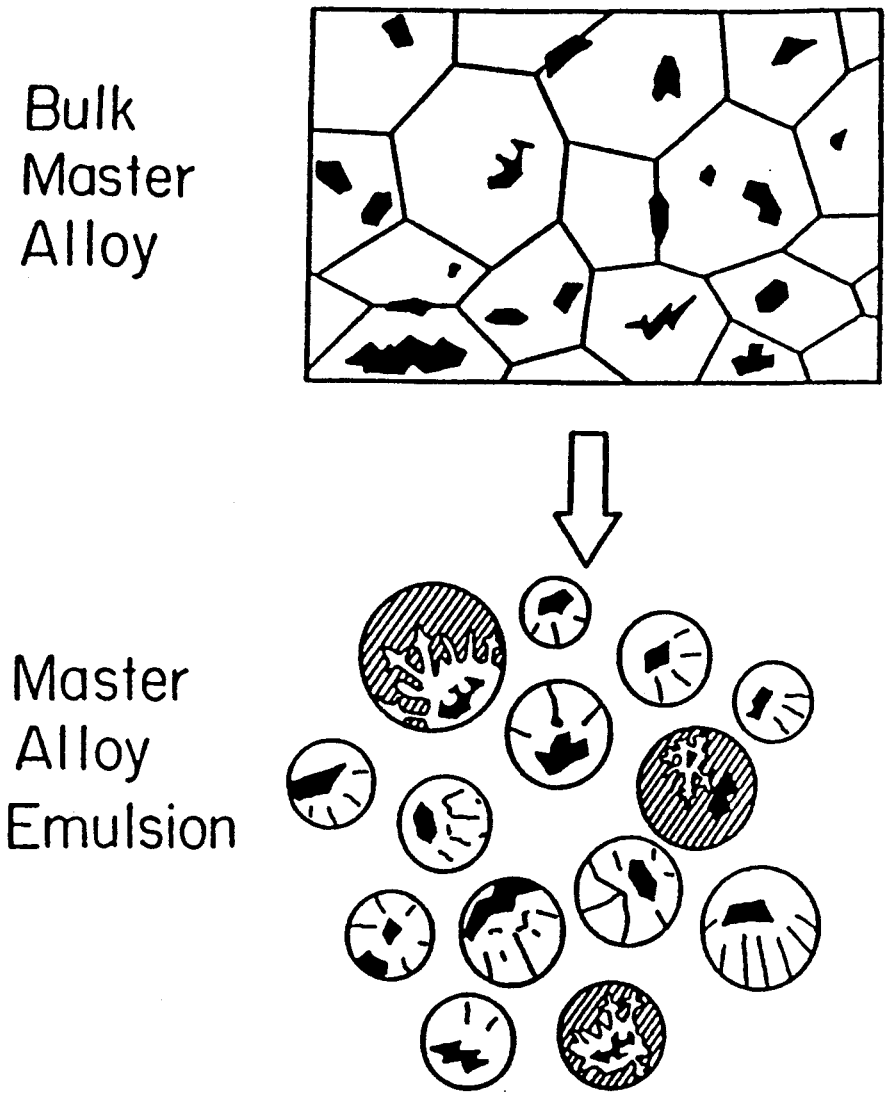
FIG. 2 is a schematic illustration of the production of master alloy droplet emulsions and corresponding droplet microstructures which differentiate effective inoculants from ineffective particles.

The invention procedure is used in conjunction with thermal analysis quenching treatments and/or a series of thermal analysis measurements of the droplets containing the incorporated particle catalysts. For specific information concerning the thermal analysis of materials consult *Differential Thermal Analysis a Guide to the Techniques and its Applications,* M. I. Pope and M. D. Judd, Heyden Pub., London 1977. By using the DET on commercial master alloys, a dispersion of master alloy powders containing separate incorporated inoculants originally present within the bulk master alloys is produced as shown schematically in FIG. 2. From a droplet dispersion, heterogeneous nucleation responses produced from the solidification of the bulk metal or alloy on individual incorporated inoculant particles within discrete droplets from the emulsion sample can be separated and attributed to factors such as inoculant chemistry, morphology, size, and surface conditions.

A high sensitivity Differential Thermal Analysis (DTA) capable of detecting thermal signals from as little as 50 droplets 75–100 μm in size is used to correlate endothermic and exothermic events to specific inoculant species incorporated within a minor fraction of the total droplet population. Identification of the most effective inoculant species present within a master alloy emulsion is achieved by using a series of interrupted quenching treatments during thermal analysis so that original bulk metal or metal alloy droplet solidification morphologies produced after nucleation are retained.

Figure 3B:
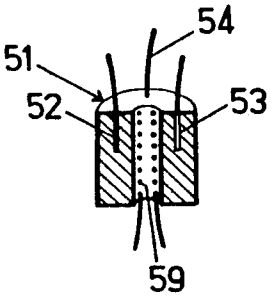
FIG. 3B is a representation of the Differential Thermal Analysis system used in the examples and in accordance with the present invention.
Figure 3A:
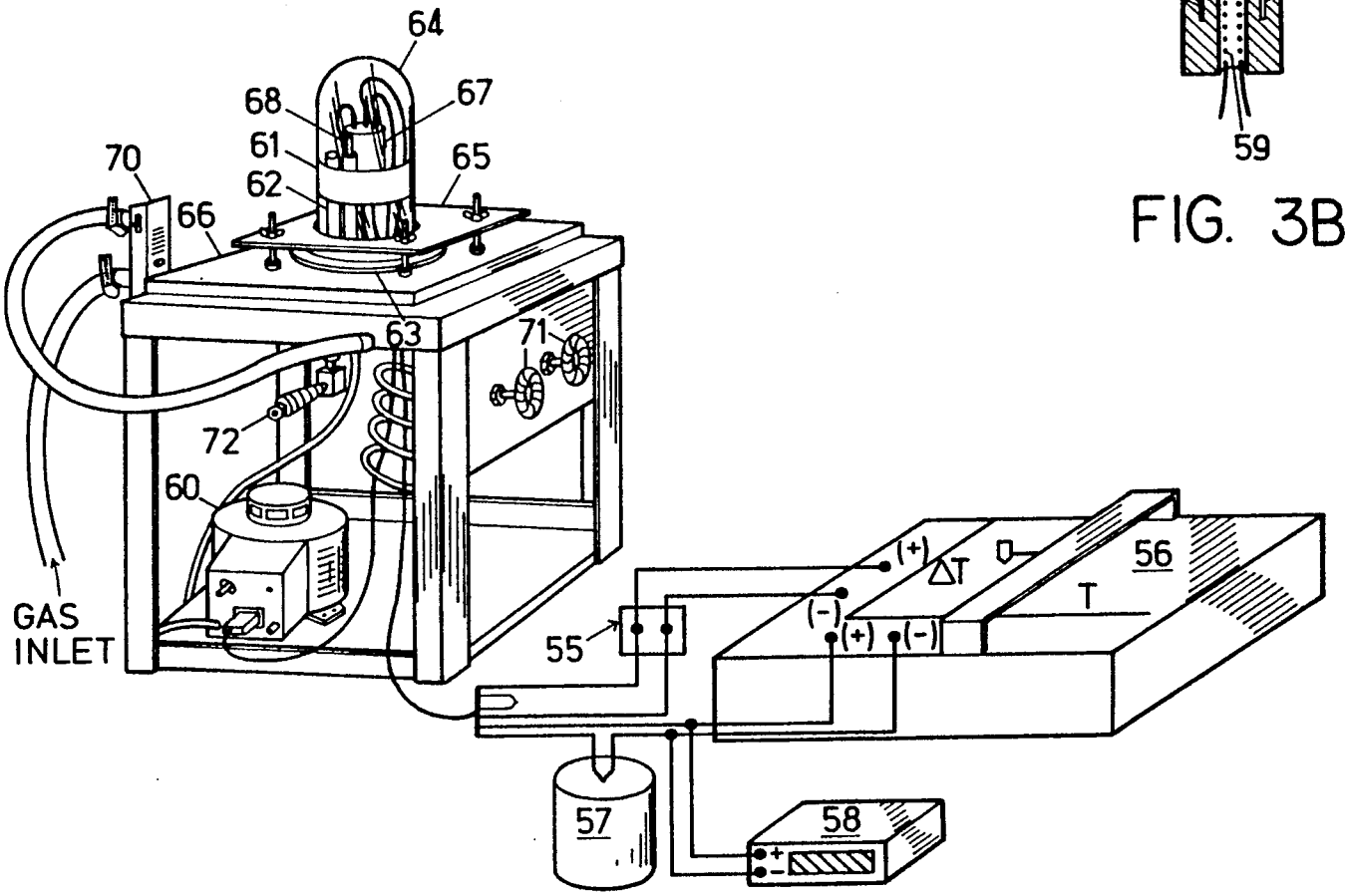
FIG. 3 composed of FIG. 3A

The DTA system used to analyze the dispersed particle aluminum droplet emulsions is illustrated in FIG. 3. The intermediate temperature DTA apparatus used in these experiments was specifically designed and constructed for the purpose of examining aluminum and aluminum grain refining alloy powder dispersions and will be described numerically with the aid of an illustration of the systems as shown in FIG. 3. A 2.54 cm diameter 5.08 cm long pure silver block 51 is used as a sample holder and contains two radially symmetric holes drilled to accept a 3 mm outer diameter quartz sample and reference tubes 52,53. Both the sample and reference tubes are filled with the respective elements of master alloy and alumina powders and contain embedded type K thermocouples 54 which are junctioned to provide for differential temperature measurement of endothermic and exothermic events that the sample undergoes relative to the transformation free reference upon heating and cooling within the silver block. These differential signals are then sent through a high gain solid state amplifier 55 and are subsequently fed into the Y-axis of an X-Y chart recorder 56. In addition to this portion of the system, a 2 mm hole opposite the tube holes is also present and accommodates a type K thermocouple which is simultaneously junctioned to an ice bath reference 57, a digital voltmeter 58, and the X-axis of the chart recorder for the purpose of exact temperature measurement of the differential signals produced on the Y-axis of the chart recorder. A ⅛ inch diameter center hole drilled through the block is also present and holds a tension fitted, stainless steel covered, 240W cylindrical resistance heater 59 which is controlled by a variable potentiometer 60. This block rests upon a circular asbestos insulation platform 61 which is secured to three threaded, hollow teflon legs 62 which are screwed into a 6 inch diameter aluminum base plate 63. On the base plate rests a circular rubber gasket which is used to seal a 4 inch diameter pyrex bell jar 64 over the entire block assembly. This bell jar is secured to the base plate by a removable steel cover plate 65 which is held in place by four threaded screws and wingnuts. The underside of this circular base plate is baffled and is bolted to a large, chamfered, rectangular, ⅝ in thick aluminum plate 66 which rests upon a rectangular steel stand.

The large aluminum plate and the circular aluminum plate each have two ½ inch circular holes and one oval shaped hole drilled into them at identical positions. The two cylindrical holes on these plates lie directly below two of the hollow teflon legs and are present as entrance and exit ports for air or inert gas coolant. Surrounding the silver block 51 rests a stainless steel radiation shield 67 connected to a capped stainless steel cylinder 68. The cylinder 68 is coupled to the gas entrance port atop one of the teflon legs. Six small pinholes are present along the capped cylinder and face the silver block. These holes act as jets for the gas coolant on the block. The oval hole present in both of the aluminum plates holds two mated 15 prong D-plugs which are used as interconnects for the three thermocouples and the lead wires of the resistance heater from the inside of the bell jar to the external equipment.

Beneath the large aluminum plate is a plumbing network made of copper tubing swagelocked to the base plate 9 which serve as entrance and exit pathways for the cooling gases. Both cooling and heating rates are controlled by manual adjustment of the resistance heater potentiometer and gas flow as well. The relative gas flow is determined by use of a flowmeter 70. Because of the high thermal conductivity of the silver block, large differences in obtainable cooling and heating rates can be achieved. Typically, these rates can be varied and controlled and range from approximately ½ to 100° C./min. In addition, thermal analysis under positive gas pressure or mild vacuum is also possible by using the gas flow shut off valves 71 on the face of the system or by using the vacuum fitting 72 located under the base plate assembly.

The design of this DTA offers several advantages for the analysis of the dispersed droplet populations of aluminum master alloy powders. Because the thermocouples are embedded within the sample and reference materials, thermal barriers are not present within the apparatus. Due to this design feature, the system is extremely sensitive and can record very small differential signals produced from the liberation or extraction of heat from the aluminum powders relative to the alumina reference during the melting and subsequent nucleation of the droplet samples. This feature allows for the thermal analysis of a very small number of droplets or the analysis of a population of droplets from a very small size range. In addition, because of this design, thermal lag within the system is also reduced to a minimum and therefore multiple melting and nucleation signals produced within very small temperature ranges from these droplet populations may also be detected and separated on the chart recorder. The differential signals produced from these droplet samples can range anywhere from 0.25 μV to approximately 100 μV/cm and can be separated as discrete thermal signals within a temperature range of approximately 1° to 2° C. at the present time on the X-Y recorder. In future studies, the addition of a solid state amplifier to the X-axis input of the recorder will allow for nucleation and melting signal peak separation within a temperature range of much less than 1° C.

The principle of DTA is to examine the behavior of a sample which undergoes thermal transformation and compare it to a sample that is transformation free. The transformation free sample in this case is known as a reference sample. By simultaneously heating and cooling a reference sample and an emulsion sample within the DTA block, a temperature differential is observed when the emulsion sample undergoes melting or nucleation. These temperature differentials are easily monitored with the use of the reference or ice junction and the three thermocouple wires. By placing one thermocouple in contact with the ice junction and the reference sample, a temperature baseline on an X-Y recorder can be established along the X-axis. The two other thermocouples are used to monitor the temperature difference between reference and emulsion samples. Any thermal event that occurs within the emulsion sample is recorded as a difference in temperature with respect to the reference sample and is recorded along the Y-axis of the chart recorder. It is important to note that no physical contact exists between the thermocouple wires and the the liquid metal droplets which are surrounded by a surface coating within the emulsion sample.

With this configuration, the reference temperature thermocouple signal is carried directly to the X-Y recorder by copper extension wires. The microvolt-range differential signal, however, is first modified by a high-gain solid state amplifier and then fed into the Y-axis recorder input. Differential signals produced are usually between 1 and 100 microvolts per centimeter.

Figure 4:
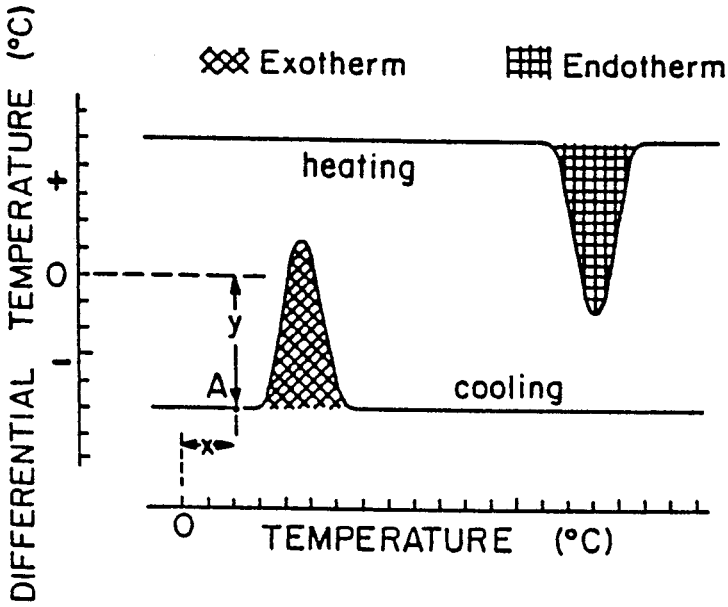
FIG. 4 is an illustrative example of a DTA trace showing negative and positive deviations from the observed baseline during heating and cooling of a sample.

In a DTA trace, endothermic and exothermic events appear as negative and positive deviations from the observed baseline during heating and cooling of a sample. This is illustrated in the schematic diagram of FIG. 4 for a pure material. The reaction temperatures are interpreted along the horizontal X-axis in mV, corrected by the differential temperature along the vertical Y-axis in μV, at the point measured. For example, in FIG. 4 the sample temperature is given by:

$$X(mV)+Y(\mu V)$$

Under ideal conditions, both the melting and crystallization temperatures should appear as sharp spikes in the differential thermal signal. Depending upon the size range of the droplet distribution and cooling rate used, however, the observed crystallization peaks on a thermogram are usually somewhat broadened as compared to that of an ideal situation.

In order to determine the stability of a nucleation event induced by either an applied surface coating or an incorporated particle catalyst, a thermal cycling treatment is used during differential thermal analysis. This treatment simply consists of a series of successive heating and cooling cycles and enables one to obtain complete cycles of melting and solidification in order to verify endothermic and exothermic temperatures of importance.

In bulk samples that are generally used in standard grain refinement tests, visual correlation of potent inoculant species to secondary bulk metal or metal alloy solidication morphologies, such as is the case for aluminum, is not possible because of matrix coarsening and other microstructural modification that result from the slow cooling of as-cast standards. In bulk samples, it is only possible to examine the overall effectiveness of master alloys by measuring resultant as-cast grain sizes. The issue of specific nucleant identity within a bulk sample cannot be addressed in a reliable and efficient manner. However, in droplet samples quenched at specific intervals during a nucleation cooling cycle, matrix microstructures associated with the nucleation and growth morphologies of aluminum off of both effective and less potent incorporated catalysts are preserved. Therefore, microstructural differentiation can be used to distinguish effective inoculants from the less effective intermetallic particle population. Moreover, because the quenching treatments are performed at known temperatures, the actual potency of inoculant particles contained within droplets possessing characteristic solidification microstructures associated with effective nucleation can be identified and used to establish a catalytic ranking of particles contained in a master alloy. Furthermore, since background sites such as crucible walls or stirring rods are also eliminated by this process, residual catalytic interactions are eliminated in addition to providing for an effective means to identify differences between isolated inoculant particles which promote grain refinement in a bulk solid.

There are numerous candidate materials for which this evaluative approach is beneficial for the identification of potent inoculant species for the subsequent improvement of existing inoculant additions and the development of more effective inoculation agents. Of primary concern are pure aluminum and aluminum alloys which are typically refined through master alloy additions containing particle dispersions such as $Al_3Ti$, $TiB_2$ or intermediate $(Al,Ti)B_2$ phases. Essentially, all aluminum alloys produced with ingot technology require grain refinement additions to insure proper fabrication requirements and consistent, uniform working properties. Complications associated with this processing step include the fact that most aluminum alloys cannot be grain refined with a single or universal refining agent. Thus, specific refining agents are in general required for individual alloy designations. In almost all aluminum grain refinement operations, there is also an optimal contact or holding time for the added particles to become effective over specific time periods and each of these time intervals can differ for individual alloys and refining agents. In many aluminum alloys, the grain refinement process is extremely difficult to achieve at an industrially acceptable limit through an inoculation treatment due to a phenomenon known as poisoning. This poisoning effect is associated with impurity effects or the presence of a specific solute addition in a particular alloy that for reasons which remain unclear to the present art, render inoculant additions inactive in the grain formation process. In cases where poisoning effects dominate, manufacturers must resort to more costly procedures which may or may not produce sufficient grain refinement, such as electromagnetic stirring.

In the prior art, various solute additions such as boron, carbon, or beryllium have been suggested to improve the effectiveness of grain refinement additions, extend effective holding periods and circumvent poisoning effects, but with the use of bulk alloys none of these suggested treatments can be verified. Any improvements in refinement effectiveness can only be inferred, at best, with empirical bulk grain density measurements. However, parameters influencing the improvement of inoculation treatments with solute additions and the individual catalytic agent(s) procuring enhanced grain refinement cannot be identified in bulk samples.

The above statements are true not only as applied to aluminum and aluminum alloys, but in other alloy systems requiring pre-solidification, microstructural modification additions such as in zinc, lead, iron, and copper alloys as well. However, by producing an emulsion of a master alloy liquid, pure metal liquid, or alloy liquid that contains a particular inoculant addition, at a temperature at which the particulate inoculation agents remain suspended within the liquid, or at a temperature at which inoculant solutionization occurs, inoculants used for structural modification are either incorporated within or nucleate within discrete, individual droplets in the emulsion sample. Since the total inoculant particle population may contain sub-populations of particles possessing different catalytic potencies, droplet processing provides physical separation of the inoculant particle population so that discrete droplets within the emulsion can contain the incorporated particles of variable potency. The variable potency inoculants are identified by thermal analysis and quenching techniques that verify inoculant operation and provide microstructural proof of effective and ineffective catalysis from individual inoculant particles incorporated within single droplets in the emulsion population. An important aspect of the approach included in the thermal analysis procedures is the confirmation of inoculant site identity as related to interaction between the applied droplet surface coatings, the intended catalyst particles, and liquid droplet matrices. In these procedures, it can be proven that the applied surface coatings on the droplet surfaces are catalytically inert in relation to changing alloy melting behavior or altering inoculant potencies through catalytic site interaction. This procedure assures the true verification of intended site catalysis. These outlined procedures are used on a spectrum of metals and alloys containing particulate inoculants.

EXAMPLES 1-3

Bulk samples of high purity aluminum (99.999% Al) were used to make liquid aluminum droplet emulsions that were processed in three types of molten eutectic salt carrier solutions: 1) KCl—LiCl; 2) $K_2SO_4$—$Li_2SO_4$; or 3) $KPO_3$—$NaPO_3$ by using the apparatus shown in FIG. 1. In each of the three examples, 2 gm bulk pieces of solid aluminum were placed in alumina crucibles that contained 50 gm of one of the molten eutectic salt solutions listed above and were held at a temperature of 700° C. by containing the crucibles in pot furnaces. The molten salt solutions containing the aluminum were held at this temperature for 10 minutes to insure complete melting of the aluminum and temperature equilibration. A ceramic shearing blade attached to a high speed electrical motor capable of a maximum rotational speed of 30,000 rpm controlled by a variable potentiometer was placed into the molten salt and molten aluminum contained in the crucible. The motor was turned on and mechanically sheared the bulk molten aluminum into a dispersion of fine liquid aluminum droplets ranging from 5-300 μm in diameter over a period of 2 to 5 minutes. After emulsification, the molten salt/liquid aluminum droplet emulsion mixture was poured onto an aluminum quench plate and allowed to cool to room temperature. The solidified emulsified mass was then placed in a 1000 ml beaker of distilled, deionized water and the solid salt carrier was allowed to dissolve. The solid aluminum droplets were then recovered by filtration through glass microfiber papers with 2 μm pore openings.

Figure 5:
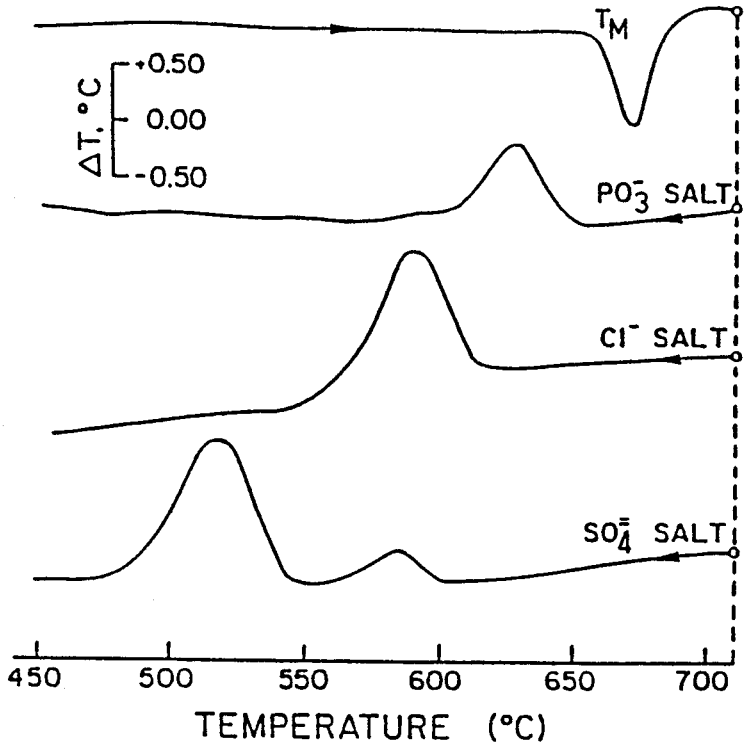
FIG. 5 is a series of differential thermograms illustrating the melting and nucleation behavior of pure aluminum droplets produced in various molten eutectic salt solutions.

During the emulsification process, an aluminum oxide reaction product forms an integral coating on the droplet surfaces that maintains droplet emulsion integrity of the sample and prevents agglomeration of the finely divided liquid aluminum spheres. Auger electron spectroscopy has revealed that the oxide surface coatings on the droplets can contain residual anions from the respective carrier salt solutions that alter the catalytic potency of the applied oxide surface coating inoculation sites as shown by the change in nucleation undercooling during differential thermal analysis cooling cycles for each of the three example emulsions in FIG. 5. However, a change in pure aluminum melting behavior does not occur in FIG. 5 for each of the emulsion samples, indicating that the incorporation of salt anions into the droplet surface coatings does not alter the equilibrium melting behavior of the aluminum droplet populations. The absence of such interaction establishes that applied coating treatments and reactions used for droplet emulsion processing are restricted to droplet surface inoculation and do not act as impurity contaminants in the bulk metal.

EXAMPLE 4

A dilute bulk high purity (99.99%) alloy of Al-1 wt. % Ti was made at approximately 100° C. above its liquidus temperature (≈800° C.) by adding the required titanium solute addition to 10 gm of molten aluminum held under 50 gms of a molten eutectic salt flux solution of KCl-LiCl, and was mechanically stirred for several hours under an argon cover gas to insure alloy homogeneity and oxidation prevention. After removal of the bulk alloy from the salt as described above for Examples 1-3, two 2 gm samples of the alloy were processed into emulsion form at temperatures approximately 50° C. above the liquidus temperature of the alloy in molten eutectic salt solutions of either KCl—LiCl or $K_2SO_4$—$Li_2SO_4$ and were recovered from the salt mixtures using the outlined procedure listed in Examples 1-3. Droplet processing of the alloy from above the liquidus promotes the formation of incorporated in situ aluminide particles that form during cooling of the alloy droplets. Differential thermal analysis of both samples revealed that nucleation undercoolings of aluminum below the equilibrium peritectic temperature of the alloy were essentially negligible (i.e. <1° C.) and were independent of droplet surface coating, thus indicating that the incorporated in situ aluminide inoculant particles effectively catalyze the nucleation of aluminum in the absence of residual nucleant site interaction from the applied oxide surface coatings.

EXAMPLE 5

Figure 6:
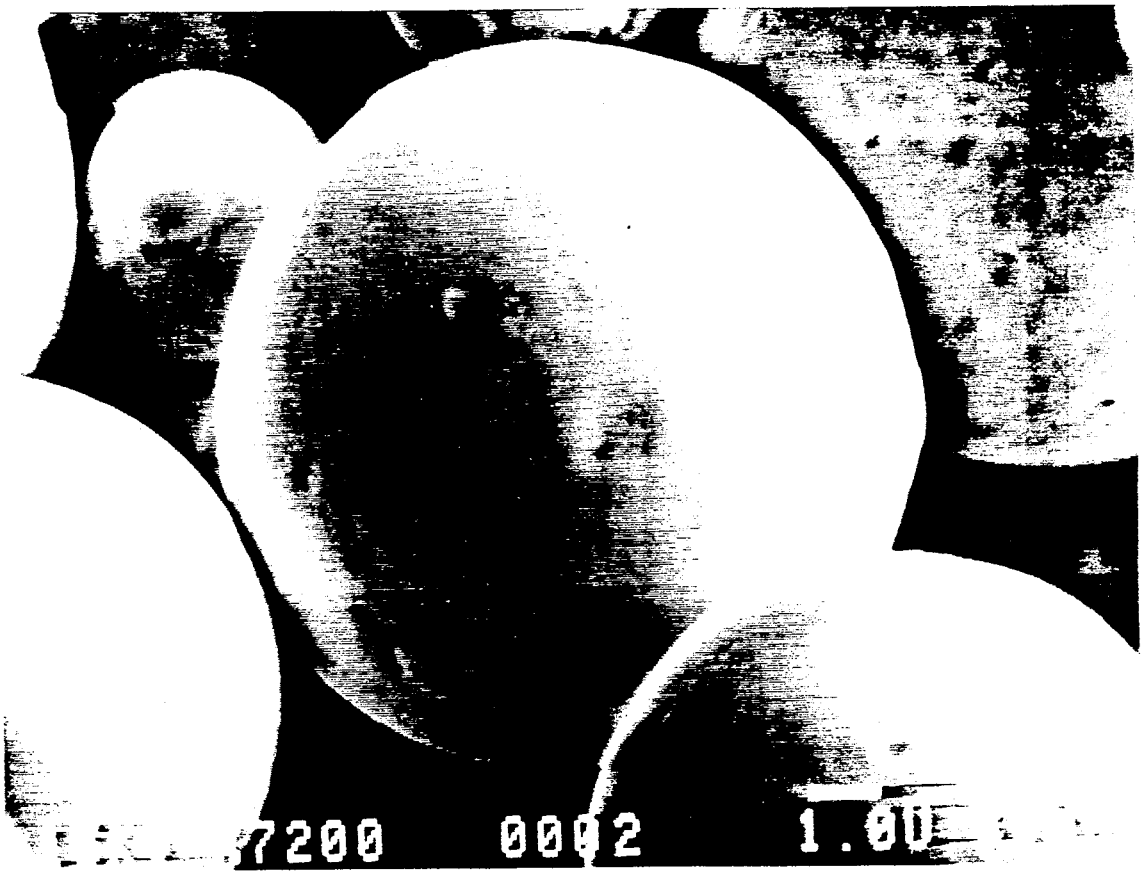
FIG. 6 is a photomicrograph of a lead droplet containing an incorporated SnTe particle catalyst on the surface of the droplet.

Pure bulk lead was processed to contain a random dispersion of externally applied, incorporated SnTe or PbTe inoculant particles ranging in size from <2 μm to 44 μm by placing 10 gm solid lead and ≈0.2 wt. % PbTe or SnTe particles in a quartz tube that was evacuated to ≈20 mTorr and sealed with a torch. The quartz capsule containing the lead and the PbTe or SnTe particles was placed in a furnace at approximately 500° C. for 5 minutes and was agitated intermittently to insure uniform dispersion of the particles in the molten lead. The samples were removed from the furnace and quenched in a water bath to insure incorporation of the telluride inoculant particles and to minimize surface segregation of the telluride inoculants resulting from density differences between the lead and the particles. The solidified ingots were removed from their capsules and droplet emulsions were made from 2 gm bulk sample pieces of the Pb-Telluride particle incorporated ingots by placing them in fluted Pyrex sample tubes with 10 ml of tritolyl phosphate oil (TTP) carrier solution that contains additions of 0.2 wt. % oil carrier volume of phosphotungstic acid (PWA) which acts as a droplet surfactant during emulsification. An apparatus as shown in FIG. 1 was used with a stainless steel shearing blade to make an emulsion as described in Examples 1-3 at a 50° C. superheat temperature of ≈380° C. This processing results in droplets containing discrete incorporated particle catalysts which nucleate the lead solid phase during cooling of the droplet sample. The resultant potency of the externally applied, incorporated catalyst particles were measured in terms of nucleation undercooling of the droplets which occurs at an undercooling level significantly less (100° C.) than that produced in lead droplets without incorporated telluride particle additions. The sample was then removed from the carrier fluid through successive washings in acetone and was microstructurally examined on a scanning electron microscope to identify the active catalyst particles within the lead droplets, as shown in FIG. 6.

Because subsequent microscopic examination can be used to verify the incorporation of externally applied dispersed phase inoculant particles in droplets, the degree of particle incorporation associated with the mutual wetting characteristics between the liquid metal and the dispersed phase can also be examined. Since favorable wetting conditions between liquids and particle catalysts generally promote good composite compatability in addition to effective nucleation catalysis, the present invention can be used as a screening device to examine mutual compatibility between dispersed phases and liquids in the development of novel composite materials.

EXAMPLE 6

Al-3Ti-1B master alloy rod stock used for commercial, industrial scale inoculation treatments in the grain refinement of aluminum and aluminum alloy ingot castings were processed into droplet emulsions in a molten KCl-LiCl eutectic salt solution at ≈800° C. using the procedure outlined in Examples 1-3. At the 800° C. processing temperature, the emulsion sample was comprised of droplets of a liquid aluminum solution containing incorporated pre-existing inoculant particles originally present in the bulk solid commercial master alloy rod stock. After recovery of the solidified droplets, thermal analysis measurements were performed. The thermal analysis measurements indicate that droplets contain inoculant particles of variable effectiveness which initiate nucleation of aluminum at discrete, low undercooling levels ranging from ≈0° to 15° C. below a heating reaction associated with the final melting of solid aluminum, thereby indicating that inoculant particles of variable catalytic potency as potential nucleants for aluminum exist in the master alloy sample. By quenching the sample from the emulsification temperature, droplets microstructures revealed that aluminide (i.e. $Al_3Ti$) inoculant particles exist within aluminum grain centers while the diboride phase (($TiB_2$ or $(Al,Ti)B_2$) particles are situated within interdendritic or intercellular regions of individual droplet grains indicating that diboride particles are inactive as nucleants for aluminum and effective nucleation associated with the negligible undercooling of aluminum measured during thermal analysis of the powder samples was due to the nucleation of aluminum from the aluminide phase.

EXAMPLE 7

Figure 7:
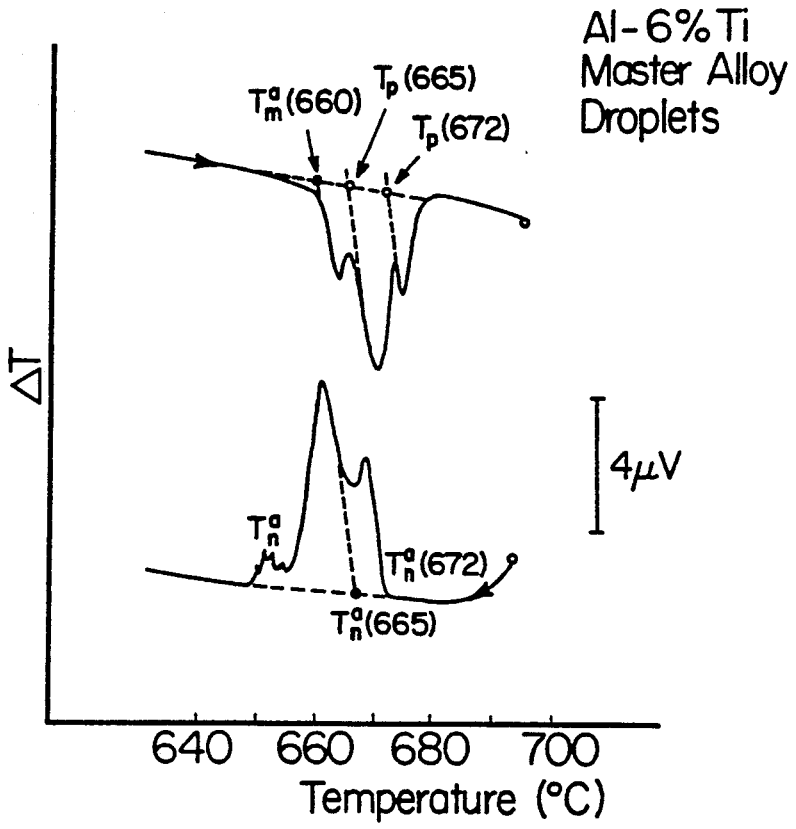
FIG. 7 is a differential thermogram illustrating the melting and nucleation/solidification behavior of a droplet emulsion produced from a bulk sample of a commercial Al-6 wt. % Ti grain refining master alloy.
Figure 8:
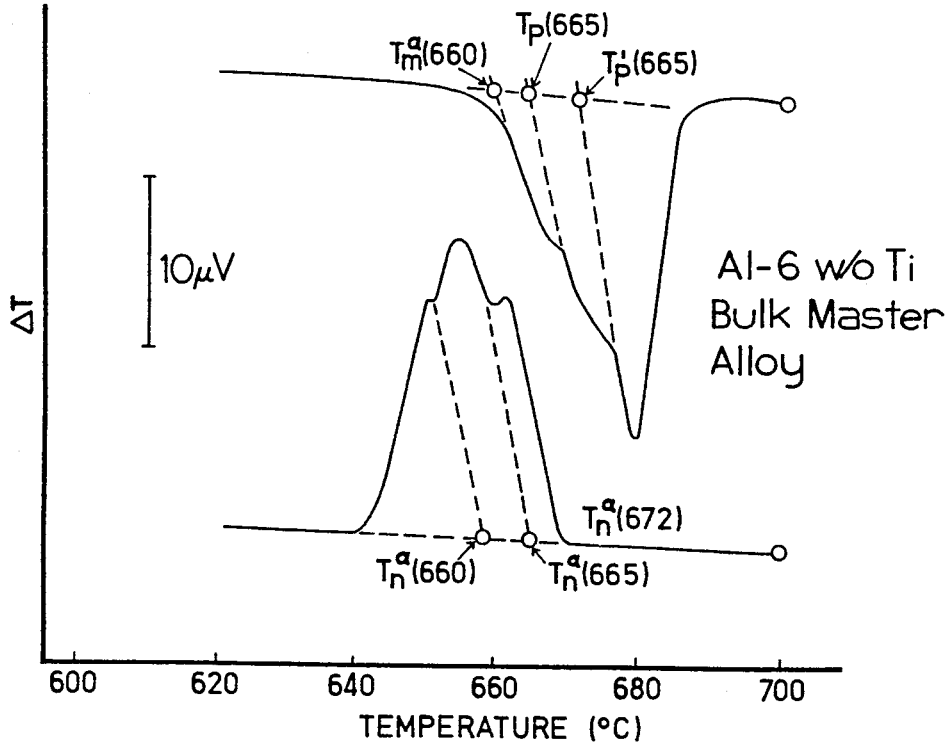
FIG. 8 is a differential thermogram illustrating the melting and nucleation/solidification behavior of a bulk sample of the commercial Al-6 wt. % Ti grain refining master alloy.

Al-6Ti master alloy rod stock used for commercial, industrial scale inoculation treatments in the grain refinement of aluminum and aluminum alloy ingot castings was processed into droplet emulsions in a molten KCl-LiCl eutectic salt solution at ≈800° C. using the procedure outlined in Example 6. Variable potency inoculants in terms of nucleation undercooling similar to the responses discussed in Example 6 were also observed during the differential thermal analysis of the Al-6 wt. % Ti droplet samples containing the incorporated, pre-existing inoculant particles as well with melting and nucleation/solidification reactions associated with aluminum occurring at temperature of <660, 665, and 672° C., as shown in FIG. 7. Of additional importance is the fact that the emulsification processing of the grain refining alloys under the described conditions in no way altered the nucleant potency of the pre-existing inoculant particles as shown by the identical melting and nucleation/solidification behavior of a bulk sample of the Al-6 wt. %Ti master alloy rod in FIG. 8. However, by producing the droplet samples of the master alloy, the nucleation events generated upon thermal analysis can be identified with different particle species of variable chemistry and morphology by using a series of intermediate quenching treatments at temperatures well above, and just below the initial nucleation onset temperature that corresponds to the nucleation of aluminum from the most catalytically potent inoculant species present within the master alloy.

Figure 9A:
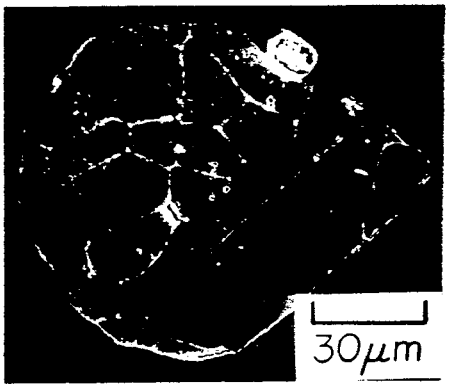
FIGS. 9A, 9B, 9C and 9D are photomicrographs of Al-6 wt. % Ti master alloy droplets that contain incorporated effective and ineffective inoculant particles that are identified by preserving droplet microstructures associated with effective and ineffective catalysis.
Figure 9B:
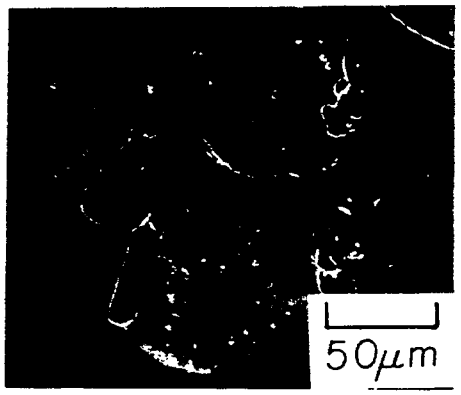
Figure 9C:
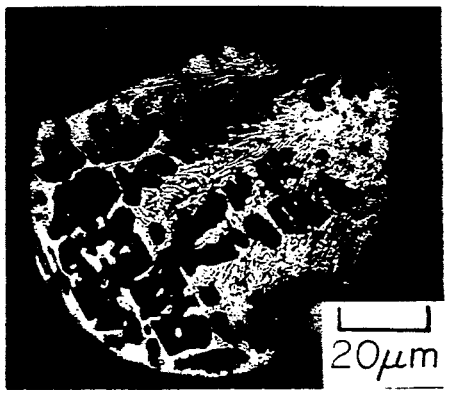
Figure 9D:
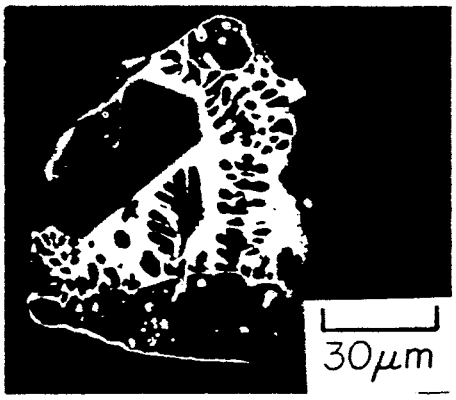

A water quenching treatment upon cooling of the droplet sample during differential thermal analysis at a temperature just below the initial nucleation onset temperature (≈671° C.) was used to identify droplets that contain the most potent inoculant particles. This treatment preserves microstructural features associated with the nucleation and growth of aluminum from only the most catalytic inoculants incorporated within some of the master alloy droplets. FIG. 9A shows that droplets containing less effective intermetallic particles were still liquid upon quenching from ≈671° C. and have cellular microstructures similar to the solidification microstructures produced in droplets quenched from a temperature above both invariant reactions (700° C.), as shown in FIG. 9B. However, in a portion of the droplets that begin to solidify prior to quenching from ≅671° C., the droplet microstructures show rounded aluminum dendrites radiating from the more catalytically potent inoculant particles, as shown in FIG. 9C. The presence of interdendritic eutectic in these droplets is also evident.

Figures 10A, 10B:
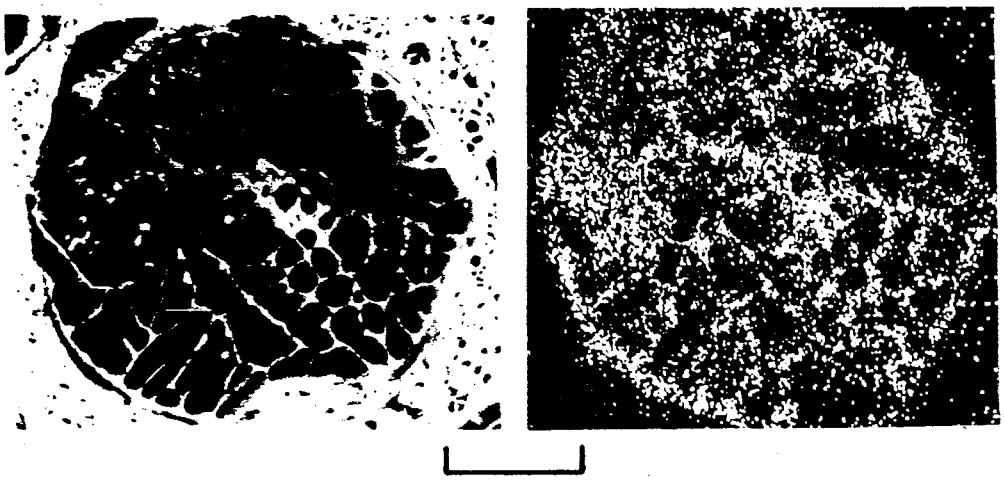
FIGS. 10A and 10B, and 11A and 11B, are photomicrographs of droplets containing effective and ineffective particle inoculants as identified with this invention and accompanying silicon X-ray maps of the droplets which show that the enhancement of inoculant potency is related to silicon concentration differences in the effective and ineffective particle inoculants.
Figures 11A, 11B:
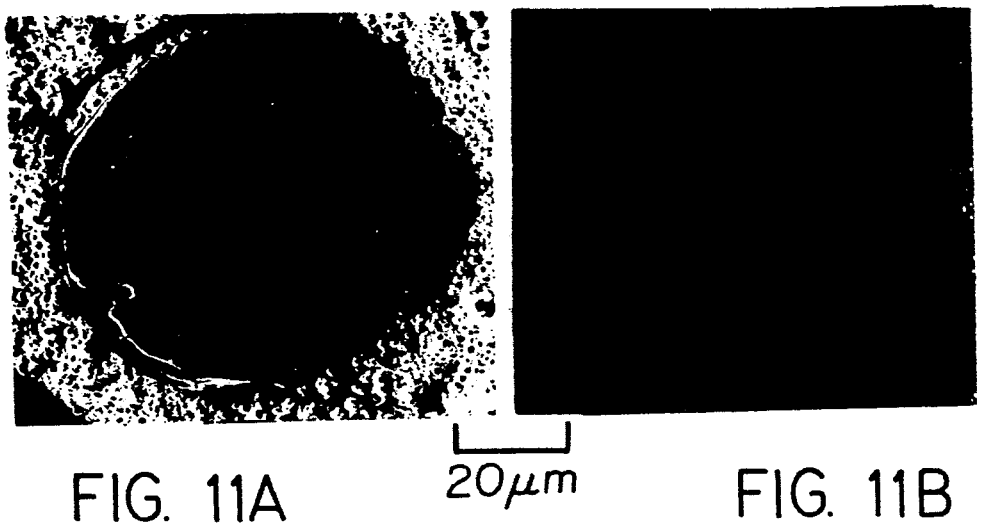

Two trends are observed upon examination of the droplets that contain the characteristic dendritic morphology. A preliminary statistical analysis, produced from a population of droplets subjected to the nucleation onset quenching treatment, shows that the percentage of droplets containing particles that promote the dendritic aluminum morphology is comparable to the actual observed grain density measurements in bulk aluminum (≅1%). This result, coupled with the approach and analysis cited in Example 6, indicates that inoculant isolation produced from the use of the present invention is an effective approach for subsequent identification of potent species used in grain refinement processes. Secondly, particles that initiate the dendritic aluminum microstructure possess morphological variances that are absent from the majority of intermetallic particles contained in most of the droplets in this example. Intermetallic particles that possess irregularly faceted growth planes and show aluminum dendrites radiating from their surfaces contain concentrations of silicon (≅4 to ≅10 atomic %, see FIGS. 10A and 10B and are the $Al_3Ti$ phase with silicon substitution (i.e., $(Al_{1-x},Si_x)_3Ti$), while the less catalytically potent, blocky, faceted particles do not contain silicon and are essentially the equilibrium $Al_3Ti$ binary intermetallic phase, as shown in FIGS. 11A and 11B. This result shows that the droplet invention can be used to identify and differentiate effective and less effective nucleant species in droplet populations by identifying nucleation exotherms with inoculant morphologies, chemistries, and resultant solidification microstructures that are preserved from interrupted thermal analysis quenching treatments.

Based upon the analysis of commercial Al-3Ti-1B (wt. %) and Al-6Ti (wt. %) master alloys as described in the current example and in Example 6, the following steps describe the analytical process for evaluation and identification for the design of effective inoculant particles used as grain refining agents:

Step 1: Process bulk metals or alloys containing inoculant particles into droplets containing incorporated inoculant particles by using the Droplet Emulsion Technique (DET), or produce incorporated inoculant particles in droplets by in situ alloying, as described in greater detail below.

Step 2: Examine droplets in cross-section for microstructural evidence of active and inactive catalysis between different particle species using optical and/or electron microscopy. In general, active particles will be present in grain centers while ineffective particles will be present at grain boundaries or in interdendritic/intercellular regions of individual droplets as described in Example 6.

1 Step 3: Perform Differential Thermal Analysis (DTA) on droplet samples in order to establish nucleation temperatures associated with the most effective inoculant particles. The most effective inoculant particles will produce nucleation at the highest observed reaction temperature encountered during the thermal analysis cooling cycle.

Step 4: After establishing the nucleation behavior in Step 3, perform thermal analysis on the same sample. During the cooling cycle, quench the sample upon initial observation of the onset of the highest nucleation reaction temperature (i.e. quench the sample at a temperature just below the temperature at which the most potent inoculant particles activate solidification).

Step 5: After thermal analysis quenching, cross section the droplet sample and identify droplet microstructures that differ from droplet samples examined in the as-processed condition (Step 2). The most effective catalyst particles are identified by the microstructural features that radiate from the effective particles and differ from droplets containing less effective inoculants which appear microstructurally similar to the processed samples. The microstructural features associated with the most effective inoculant particles are typically dendrites which radiate from the catalysts as in the case of the Al-6Ti alloy. However, in the other alloy systems microstructures associated with effective nucleation from active particles may not necessarily be dendrites. For example, active catalysts could produce a cellular growth with a large cell spacing while the cell spacing in droplets containing inactive or less active catalysts could be much smaller.

Step 6: When the effective inoculant particles have been identified (according to Step 5), analytical X-ray and electron microbeam studies can be used on specific active and inactive inoculant particles in the droplets in order to identify chemical and structural differences between the effective and less effective or inactive inoculant populations.

The results of the analysis of the Al-6 wt. % Ti master alloy droplets also show that the present invention and outlined inoculant identification procedure can also be used for the design of more effective inoculation agents that are used for the microstructural modification of metals and alloys. Based upon the structural identification of the $(AlSi)_3Ti$ phase and its associated phase equilibria generated from prior investigations which partially identified several aspects of the Al-Ti-Si phase diagram (see A. Raman and K. Schubert, Z. Metallkde, 56, 1, 44 (1965) and O. Schob, H. Nowotny and F. Benesovsky, Planseeberichte, 10, 65 (1962)), the present invention can be used to identify potent inoculants developed from a new class of improved grain refining inoculants inherent to compound particles that are structurally and chemically similar to $(Al,Si)_3Ti$ and promote specific, similar properties which theoretically provide for the enhanced nucleation catalysis. From the prior art, it is known that for effective nucleation of aluminum grains, inoculant particles should promote a peritectic type reaction with aluminum and provide a surface of low atomic misfit. In addition, a commercial processing factor also needs to be considered which is known as fade, or more specifically, the dissolution of the added inoculant particles into the liquid alloy that is to be grain refined. Once dissolution occurs, the grain refining agent is no longer sufficiently active. With the use of $(Al,Si)_3Ti$ particles, however, simple constraints imposed by the ternary phase equilibria between aluminum, titanium, and silicon dictate that a resistance to particle dissolution should occur, thereby making $(Al,Si)_3Ti$ particles resistant to fading. In addition, calculations show that a lowering of crystallographic misfit between aluminum and $Al_3Ti$ occurs when silicon is added to the aluminide (i.e. $(Al,Si)_3Ti$) for a number of previously observed preferred orientation relationships (see Table 1, below).

TABLE 1

Calculated Changes in Disregistry (δ) Between Al and $Al_3$ Ti Nucleant particles Containing Silicon Additions for Several Commonly Observed Orientation Relationships (COOR).

| $Al/Al_3Ti$ (COOR) | δ(%) $Al_3Ti$ | δ(%) $(Al,Si)_3Ti$ | Si Content in $(Al,Si)_3Ti$ |
|---|---|---|---|
| (221)//(001) | 0.19 | 0.03 | 2 at % |
| (012)//(011) | 3.82 | 3.77 | 4 at % |
| (011)//(001) | 2.88 | 2.87 | 4 at % |
| (111)//(110) | 4.59 | 4.46 | 2 at % |

This disregistry effect may provide for additional enhanced catalytic efficiency of aluminide inoculants by means of tailoring inoculant lattice parameters. Finally, the addition of silicon to $Al_3Ti$ does not alter the general phase equilibria relative to the solidification pathway of aluminum in that a peritectic type reaction within the constraints of the ternary system still occurs and provides for a constitutional deterrent against rapid grain growth of aluminum. Since many solute additions can provide identical desirable aspects of a silicon addition to $Al_3Ti$ structural type aluminides, it is possible to design a realm of similar $(Al,X)_3Ti$,$(Al,Si,X)_3Ti$,$Al_3(Ti,X)$, or $(Al,Si)_3(Ti,X)$ phases that can be beneficial for the effective grain refinement of pure aluminum and specific aluminum alloys. Silicon is an important elemental ingredient that optimizes the effectivenss of $Al_3Ti$ inoculant particles. Other solutes expected to behave similarly include the elements beryllium, germanium, tantalum, vanadium, hafnium, molybdenum, manganese, chromium and an array of other elements that show partial solubility in $Al_3Ti$, all of which can be processed, analyzed and identified as effective or ineffective solute additions in inoculant particles with the use of the present invention.

For example, in order to design improved inoculation agents, the evaluation, identification and processing of aluminum droplets containing improved incorporated inoculant particles based upon $Al_3Ti$ or $(Al,Si)_3Ti$ compounds containing solute additions of an element X such as $(Al,X)_3Ti$, $(Al,Si,X)_3Ti$, $Al_3(Ti,X)$, or $(Al,Si)_3(Ti,X)$, are provided by this invention, the associated outlined inoculant identification steps (see above) and the use of in situ alloying techniques. In aluminum alloy systems, inoculant particles in commercial bulk grain refining master alloys are commonly produced by covering bulk liquid aluminum with a metal bearing salt flux such as $K_2TiF_6$ which subsequently reacts with the liquid aluminum to form $Al_3Ti$ type inoculant particles which settle into the melt. This in situ alloying technique can also be used in conjunction with the Droplet Emulsion Technique.

In situ alloying during droplet emulsion processing at temperatures ranging from 700°-1100° C., through metal bearing salt additions or metal bearing alkalai oxides to molten KCl-LiCl eutectic carrier solution containing liquid aluminum or aluminum alloys, results in the production of aluminum or aluminum alloy droplets containing incorporated intermetallic inoculant particles comprised of aluminum and combinations of the metal bearing component of the salt addition, and alloying elements present in the molten alloy prior to the salt addition. Exemplary additions for in situ alloying of aluminum droplets contained in molten KCl-LiCl carrier solutions include additions of metal bearing potassium fluoride salts and metal bearing potassium oxide compounds such as $K_2MnF_6$, $K_2MnF_6$, $K_2BeF_6$, $K_2SiF_6$, $K_2GeF_6$, $K_2MoO_4$, and $KNbO_3$. From the cited exemplary additions aluminum droplet dispersions containing incorporated alloyed variants of $Al_3Ti$ inoculant particles such as $(Al,Be)_3Ti$, $(Al,Si)_3Ti$,$(Al,Ge)_3Ti$ and an off-stoichiometry variant of $Al_3Ti$ that contains molybdenum can be produced along with many other inoculant derivative structures and chemistries by using the procedure outlined in Examples 1-3 along with any combination of similar metal bearing additives. After recovering the droplets, differential thermal analysis and thermal analysis quenching treatments can be used to identify active nucleant particles in the droplets as outlined in Example 7.

It is understood that the invention is not confined to the particular embodiments herein illustrated and described, but embraces all such modified forms thereof as come within the scope of the following claims.

What is claimed is:

1. A method of evaluating or identifying effective and ineffective inoculation agents in a bulk metal or metal alloy, the method comprising the steps of:

(a) heating the bulk metal or metal alloy to a molten state;

(b) emulsifying the bulk metal or metal alloy containing the inoculation agents in a molten state in a carrier fluid to produce micron-sized droplets;

(c) cooling the metal and the carrier fluid to cause solidification of the bulk metal or metal alloy, and simultaneously recording the thermal signals produced by the metal droplets;

(d) re-heating the bulk metal or metal alloy to a molten state;

(e) emulsifying the bulk metal or metal alloy containing the inoculation agents a second time in a molten state in the carrier fluid to produce micron-sized droplets;

(f) quenching the metal droplets just below the initial nucleation onset temperature that is derived from the recordation of the thermal signals in step (c) to preserve the microstructure at the onset of the highest nucleation reaction temperature;

(g) examining the microstructures of the droplets and segregating the effective and ineffective inoculant particle based upon the microstructures associated with effective nucleation; and (h) identifying specific active and inactive inoculant agents in the droplets.

2. The method of claim 1 wherein the molten metal alloy reacts with the carrier fluid to form a reaction product on the surface of the droplets which stabilizes the metal droplets in the emulsion.

3. The method of claim 1 wherein the droplets formed in the emulsifying steps are of a spherical shape having a diameter within the range of 5-300 μm.

4. The method of claim 1 wherein the step of identifying is accomplished by x-ray analysis.

5. The method of claim 1 wherein the step of identifying is accomplished by electron beam analysis.

6. The method of claim 1 further comprising the step of examining the microstructures of the droplets and segregating the effective and ineffective particles based upon the microstructures associated with effective nucleation, the step being performed subsequent to the step of cooling and prior to the step of re-heating the step being a preliminary screening of effective and ineffective inoculant particles.

7. A method of evaluating or identifying effective and ineffective inoculant agents in a bulk metal or metal alloy, the method comprising the steps of:

(a) heating the bulk metal or metal alloy to a molten state;

(b) emulsifying the bulk metal or metal alloy containing the inoculation agents in a molten state in a carrier fluid to produce micron-sized droplets;

(c) quenching the metal droplets to cause solidification of the metal in the droplets and preserve the microstructure thereof; and (d) detecting thermal signals and correlating endothermic and exothermic events to specific inoculation agents within a fraction of the total droplet population.

8. The method of claim 7 wherein the step of detecting is conducted simultaneously with the quenching.

9. The method of claim 7 further comprising the step of examining the microstructures of the droplets to identify the effective and ineffective inoculant particles.

10. The method of claim 7 wherein the molten metal or metal alloy reacts with the carrier fluid to form a reaction product on the surface of the droplets which stabilizes the metal droplets in the emulsion.

11. The method of claim 7 wherein the droplets are of spherical shape having a diameter within the range of 5–300 μm.

12. A method of evaluating or identifying effective and ineffective inoculation agents in a bulk metal or metal alloy, the method comprising the steps of:

(a) heating the bulk metal or metal alloy to a molten state;

(b) emulsifying the bulk metal or metal alloy containing the inoculation agents in a molten state in a carrier fluid to produce micron-sized droplets;

(c) quenching the metal droplets to cause solidification of the metal in the droplets and preserve the microstructure thereof; and (d) examining the microstructures of the droplets to identify the effective and ineffective inoculant particles based upon the microstructures associated with effective nucleation.

13. The method of claim 12 further comprising the step of detecting thermal signals to correlate endothermic and exothermic events to specific inoculation agents within a fraction of the total droplet population.

14. The method of claim 13 wherein the step of detecting is conducted simultaneously with the quenching.

15. The method of claim 12 wherein the molten metal or metal alloy reacts with the carrier fluid to form a reaction product on the surface of the droplets which stabilizes the metal droplets in the emulsion.

16. The method of claim 12 wherein the droplets are of spherical shape having a diameter within the range of 5–300 μm.

17. A method of evaluating inoculation agents in a bulk metal or metal alloy, the method comprising the steps of:

(a) heating the bulk metal or metal alloy to a molten state;

(b) emulsifying the bulk metal or metal alloy containing the inoculation agents in a molten state in a carrier fluid to produce micron-sized droplets;

(c) quenching the metal droplets to cause solidification of the metal in the droplets and preserve the microstructure thereof;

(d) detecting thermal signals and correlating endothermic and exothermic events to specific inoculation agents within a fraction of the total droplet population; and (e) examining the microstructures of the droplets to identify the effective and ineffective inoculant particles.

18. A method of evaluating inoculation agents in a bulk metal or metal alloy, the method comprising the steps of:

(a) processing bulk metals or alloys which contain inoculant particles into droplets containing the incorporated inoculant particles by the droplet emulsion technique;

(b) performing differential thermal analysis on the droplet samples containing inoculant particles to establish nucleation temperatures for effective inoculant particles;

(c) heating the droplet samples above the melting temperature of the metal in the droplets and then quenching the droplet samples upon the onset of a nucleation temperature previously determined;

(d) after the step of quenching, cross-sectioning the droplet samples and examining the droplet microstructures to identify the effective and ineffective inoculant particles in these samples.

19. The method of claim 18 wherein during the step of carrying out the droplet emulsion technique, the molten metal reacts with a carrier fluid to form a reaction product on the surface of the droplets which stabilizes the metal within the surface structure.

20. The method of claim 18 wherein the droplets formed during the droplet emulsion technique are substantially spherical in shape with a diameter in the range of 5 μm to 300 μm.

* * * * *

UNITED STATES PATENT AND TRADEMARK OFFICE

CERTIFICATE OF CORRECTION

PATENT NO. : 5,066,324

DATED : November 19, 1991

INVENTOR(S) : John H. Perepezko; Mark K. Hoffmeyer

It is certified that error appears in the above-identified patent and that said Letters Patent is hereby corrected as shown below:

Cover page, date of filing should be --Feb. 26, 1990-- instead of "Feb. 26, 1991"

Column 1, line 24, "Other" should be --other--.

Column 13, line 62 delete "1" before "Step 3"

Column 16, line 2 the first occurrence of "$K_2MnF_6$" should be --$K_2TiF_6$--

Signed and Sealed this

Thirteenth Day of April, 1993

*Attest:*

STEPHEN G. KUNIN

*Attesting Officer*

*Acting Commissioner of Patents and Trademarks*